United States Patent [19]

Hagopian

[11] 3,997,206

[45] Dec. 14, 1976

[54] PORTABLE SECURITY LOCKING DEVICE

[76] Inventor: Wayne N. Hagopian, 93 Crescent Ave., Cliffside Park, N.J. 07020

[22] Filed: Nov. 13, 1975

[21] Appl. No.: 631,846

[52] U.S. Cl. ..... 292/290; 292/258

[51] Int. Cl.[2] ..... E05C 19/18

[58] Field of Search ..... 292/297, 290, 298, 258, 292/205, 207, DIG. 30

[56] References Cited

UNITED STATES PATENTS

| | | | |
|---|---|---|---|
| 1,598,609 | 9/1926 | Hansen | 292/347 |
| 3,115,763 | 12/1963 | Bartlett | 292/DIG. 46 |
| 3,756,641 | 9/1973 | Dugan | 292/258 |
| 3,861,726 | 1/1975 | McLennan | 292/205 |

*Primary Examiner*—Richard E. Moore
*Attorney, Agent, or Firm*—Constantine A. Michalos

[57] ABSTRACT

A portable security locking device comprising a U-shaped bracket adapted for application to a conventional door at the bottom outer corner and an elongated lock bar having a plurality of apertures along its length and a telescopic extension having alignable apertures for insertion of a conventional padlock for insertion through aligned apertures. The telescopic extension being of an acute angular configuration having one leg directed towards the door frame or wall adjacent to the door for positive contact when the door is closed thereby preventing the door from opening.

6 Claims, 5 Drawing Figures

PORTABLE SECURITY LOCKING DEVICE

BACKGROUND OF THE INVENTION

1. Field of the Invention

In general, the present invention is relabled to the door locking devices, and more particularly this invention is concerned with a portable security locking device for securely locking a door from the outside of a room when the occupant of the room leaves the room.

2. Description of the Prior Art

Heretofore, conventional safety devices or door fasteners were used whereby the door fasteners were small insignificant locking mechanisms.

In the present days of mass burglarization of every type it is of public concern to protect oneself from outside intruders from breaking and entering the individual's private confinement.

Heretofore there were several safety devices such as latches, small fasteners of stamped metal and other securing devices. Most of these securing devices concentrated around the door's lock area and have not done the job satisfactorily. The intruder could use burglarizing instruments inserted into the room between the door frame and the door to unlatch the safety devices and enter the room. Other archaic devices were used for double locking the doors but did not solve the problem of preventing the breaking and entering of motel rooms or private homes. In order to prevent this breaking and entering this invention provides for a means of double locking or triple locking a door as the case may be. This portable locking device protects his private home or motel room from unauthorized outside intruders when he leaves the room.

The present invention therefore contemplates a portable securing device that can be readibly slipped on the lower outer corner of the door and secured by use of a telescopic extention which is used for contacting the door frame or the wall and locked in this position by means of a conventional padlock.

The present invention therefore resolves the problem of breaking and entering to a large extent, by providing a portable locking device to be used as an extra precaution against illegal entering a home or motel room.

SUMMARY

The present invention contemplates a portable security locking device for rapidly locking the door of a private home or motel room to prevent unauthorized intruders from entering said home or motel. The invention provides for a portable security locking device for double or triple locking a door. The portable security device can be fitted into a suitcase which may be carried by the owner from motel room to motel room and which can be readily assembled to be used as a security device against outside intruders when he leaves the room.

The U-shape of the portable locking device is slipped through the lower right hand corner of the door which is usually spaced from the floor, and the acute angular extention is assembled unto the elongated lock bar, which in turn is locked in position by the padlock when said angular extension is in contractual relation with the door frame or wall surface. The angular extension therefore produces a positive contacting relationship with the door frame or wall at one lower corner of the door.

Therefore a primary object of this invention is to provide for a portable security locking means for use as a safety door securing device to inhibit unauthorized entrance which device can be disabled so it can fit in a suitcase and which can be assembled for externally contacting the wall area and thereby accomplish a positive contacting locked relationship.

Another object of this invention is to provide for a portable security locking device that can be rapidly assembled and used as a safety device to temporarily or more permanently secure a door of a motel or private house to protect the motel or private house against outside intruders.

Still another object of the invention is to provide for a portable security locking device which contemplates a positive external contacting relationship of the door and wall area thereby providing for an additional locking device in addition to the existing lock to thereby inhibit the opening of the door by unauthorized intruders.

Still another object of this invention is to provide for a portable security locking device which is of minimum complexity to a point where a child can utilize it and can lock the door from the outside and thereby prevent any unauthorized intruders.

A further object of this invention is to provide for a portable locking means having improved means of securing a door against outside intruders utilizing minimum number of parts and which is economical to manufacture.

These and other objects and features of the invention are pointed out in the following descriptions in terms of the embodiments thereof which are shown in the accompanying drawing. It is to be understood however; that the drawing is for the purpose of illustration only and are not a definition of the limits of the invention.

BRIEF DESCRIPTION OF THE INVENTION

DESCRIPTION OF THE PREFERRED EMBODIMENT OF THE INVENTION

Figure 1:
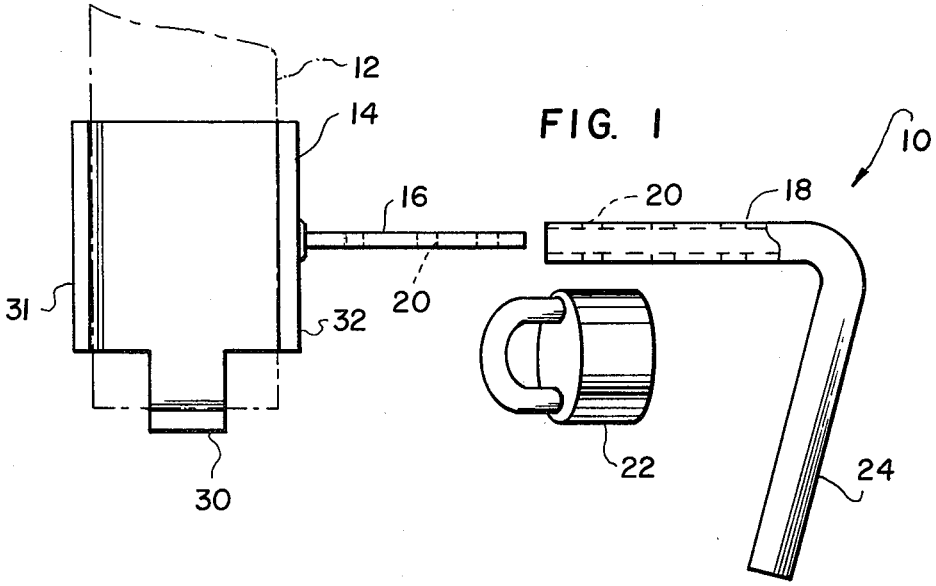
FIG. 1 is a plan view of a portable security locking device in a disassembled position in accordance with a preferred embodiment of the invention.
Figure 2:
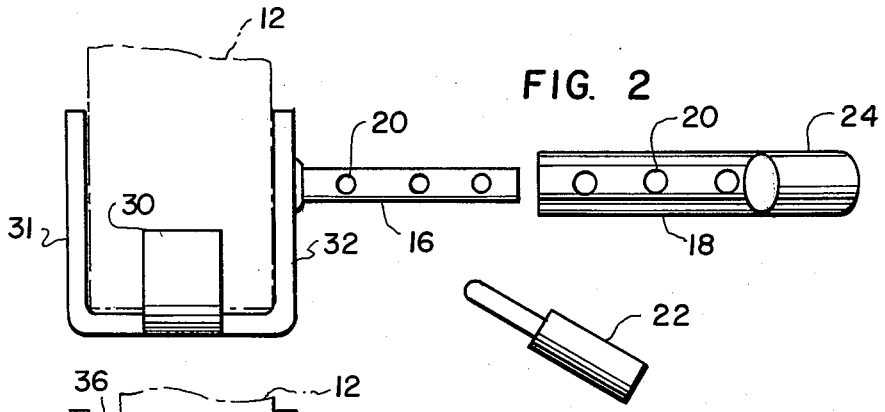
FIG. 2 is an elevational view of the invention shown in FIG. 1.
Figure 3:
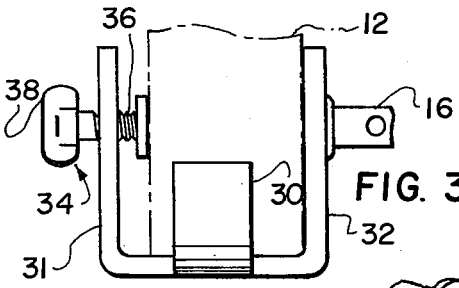
FIG. 3 is a fragmentary view of the door and a clamping means of a second embodiment of the invention.
Figure 4:
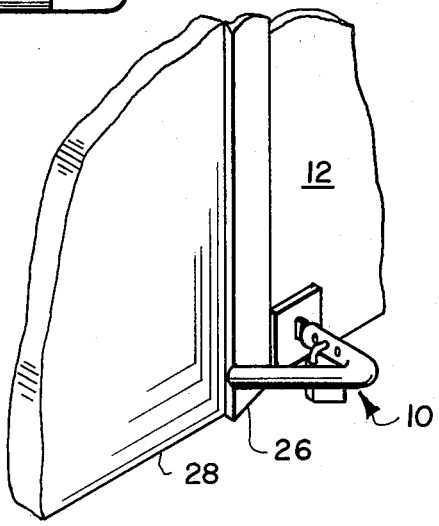
FIG. 4 is a perspective view showing the security locking device in an assembled position as utilized to lock a door.

Referring to the drawing, a portable security locking device 10, is adapted for double or triple locking a door 12, from the outside. The locking device 10, is comprised of a U-shaped bracket 14, an elongated lock bar 16 and a telescopic acute angle extension 18. The elongated lock bar 16 and the extension 18 include alignable apertures 20, through which a conventional padlock 22, is inserted to lock the bar 16, and the extension 18 together at a location wherein one leg 24, is in contactual relation with a doorframe 26 or wall 28, which is adjacent to the door 12. The door 12, is therefore locked and is prevented from being open inwardly as best shown in FIG. 4.

Figure 5:
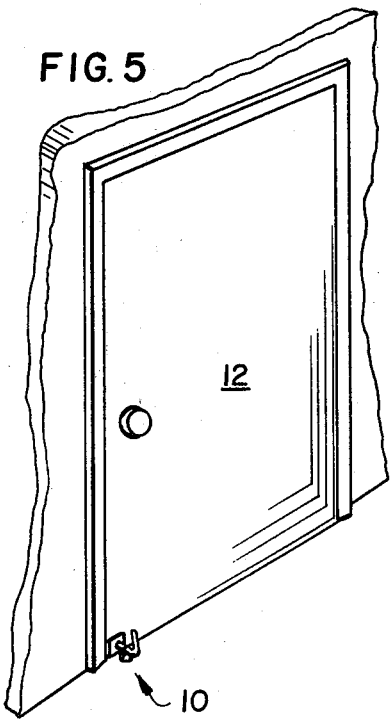
FIG. 5 is the locking device as in an unused position, permitting the opening and closing of the door.

The elongated lock bar 16 and the angular extension 18, are preferably made of circular configuration so that the angular extension 18, may be rotated 90° in an unused position, permitting the opening and closing of the door, as best shown in FIG. 5.

The U-shaped bracket 14 further includes an angular stop 30, which is disposed at right angles to two sides 31 and 32 of the bracket 14, so that the bracket may encompass the door or at the corner thereof.

A second embodiment of the invention includes a clamping means 34 having a threaded portion 36 and a wing-nut 38 for locking the bracket 14 in position unto the door 12, when the bracket 18 is slided in position unto the corner of the door 12.

In the operation of the portable security locking device 10, the U-shaped bracket 14 is slidably installed onto the lower corner of the door 12, until the stop 30 of the bracket 14, contacts the end of the door. If the locking device includes the clamping means 34, it may be locked in position by rotating the wing nut 38. The angular extension 18 is then inserted onto the lock bar 16 and moves towards the door until one leg 24 of the extension 18 contacts the doorframe 26 or wall 28. The padlock 22 is then inserted through aligned aperture 20, and locked into position preventing the opening of the door.

To position the security locking device in an unused position, the angular extension 18 is merely rotated 90° so that its leg 24 is out of line of the doorframe 26 or wall 28, thereby permitting the opening and closing of the door 12, while the locking device is still on the door.

While the present invention has been described in preferred embodiments, it will be obvious to those skilled in the art that various modification can be made therein within the scope of the invention.

What is claimed is:

1. A portable security locking device comprising an engagable bracket for encompassing a door having a doorframe, an elongated lock bar on said bracket having a plurality of apertures along its length and a telescopic extension longitudinally movable on said lock bar having alignable apertures and a locking means threaded through predetermined aligned apertures of said lock bar and extension, with referred to extension having means for positive contact of the doorframe, when said extension is locked in the predetermined position of said lock bar, thereby preventing the door from being opened.

2. The structure of claim 1, wherein said telescopic extension is of an angular configuration having one leg for contacting the frame of said door thereby preventing the opening of the door when the locking means is in position.

3. The structure of claim 1, wherein said locking means is a padlock.

4. The structure of claim 2, wherein said angular extension is of a cross-sectional shape that can be positioned out of line of the doorframe permitting the opening and closing of the door when the locking device is not in use.

5. The structure of claim 1 wherein said bracket includes two sides and an angular stop which is disposed at right angles to said two sides for encompassing the door.

6. The structure of claim 5, further comprising a clamping means secured on said bracket for locking the bracket in position onto the door.

* * * * *